US006016989A

United States Patent [19]

Gangemi

[11] Patent Number: 6,016,989

[45] Date of Patent: Jan. 25, 2000

[54] PAPER WEB AUTOSPLICER

[75] Inventor: Donald Gangemi, Great Barrington, Mass.

[73] Assignee: Beloit Technologies, Inc., Wilmington, Del.

[21] Appl. No.: 09/139,289

[22] Filed: Aug. 24, 1998

[51] Int. Cl.[7] ..... B65H 19/18; B65H 19/20

[52] U.S. Cl. ..... 242/553; 156/159; 156/506; 242/556.1

[58] Field of Search ..... 242/552, 553, 242/554.2, 556.1; 156/506, 505, 159, 258, 263, 304.1, 324

[56] References Cited

U.S. PATENT DOCUMENTS

| | | | |
|---|---|---|---|
| 3,298,890 | 1/1967 | Hellemans | 242/552 |
| 3,824,143 | 7/1974 | Cooper et al. | 156/505 |
| 4,238,261 | 12/1980 | Tetro . | |
| 4,379,012 | 4/1983 | Heymanns . | |
| 4,421,590 | 12/1983 | Meschi | 156/506 |
| 4,526,638 | 7/1985 | Clements | 156/506 |
| 4,637,566 | 1/1987 | Kyytsonen . | |
| 4,668,328 | 5/1987 | Kyytsonen . | |
| 4,705,226 | 11/1987 | Goetz . | |
| 4,802,632 | 2/1989 | Fukuda et al. . | |
| 4,881,695 | 11/1989 | Beisswanger . | |
| 4,892,263 | 1/1990 | Beisswanger . | |
| 4,936,942 | 6/1990 | Sollinger et al. | 156/504 |
| 4,951,893 | 8/1990 | Yuito . | |
| 5,066,346 | 11/1991 | Long et al. | 156/506 |
| 5,094,394 | 3/1992 | Saukkonen . | |
| 5,169,082 | 12/1992 | da Silva et al. . | |
| 5,212,002 | 5/1993 | Madrzak et al. . | |
| 5,259,910 | 11/1993 | Biagiotti . | |
| 5,279,471 | 1/1994 | Peters . | |
| 5,288,034 | 2/1994 | Schonmeier et al. . | |
| 5,487,805 | 1/1996 | Boriani et al. | 242/556.1 |
| 5,698,060 | 12/1997 | Long | 242/553 |
| 5,732,903 | 3/1998 | Madrzak | 242/554.5 |
| 5,783,029 | 7/1998 | Stettner et al. | 242/553 |
| 5,797,561 | 8/1998 | Madrzak | 242/554.6 |

FOREIGN PATENT DOCUMENTS

| | | |
|---|---|---|
| 0 580 188 B1 | 2/1991 | European Pat. Off. . |
| WO 95/34496 | 12/1995 | WIPO . |

*Primary Examiner*—John M. Jillions

[57] ABSTRACT

A method and apparatus is disclosed for effecting, in a preferred embodiment, a double-sided web splice for paper webs produced in the papermaking process. A trailing portion of a first paper web is held and cross-cut over a support beam which is selectively moved into, and out of, supporting position beneath. The leading portion of a second paper web is brought into position over the support beam where the second paper web is also held and cross-cut. Carriages containing first and second tape means traverse the trailing and leading edges of the webs. On one carriage is mounted a plow-like web lifting and separating apparatus for contacting the leading and trailing edges of the webs and forming a splice bed between the temporarily lifted and separated web edges. A first tape means is mounted to the carriage to extend an adhesive tape in the web bed, the tape having a non-adhesive side supported on the beam. A second tape dispensing apparatus is mounted to a second carriage for applying a second adhesive tape with an adhesive side facing downwardly against the edges of the first and second webs over the support beam. A web pressing apparatus is mounted on the second carriage downstream of the second tape dispensing apparatus for pressing the tapes together to splice the webs together.

4 Claims, 7 Drawing Sheets

45

45

45
43

64
2C
40
60
2C
2B
45
41
G
66,66'
H
64a
2A
2B
66,66'
D
60a
58
58a
2A
45a
80
41a

PAPER WEB AUTOSPLICER

BACKGROUND OF THE INVENTION

1. Field of the Invention

This invention relates to the art of splicing two paper webs together. More particularly, this invention relates to a method and apparatus for effecting a so-called saleable splice between the trailing edge of the trailing portion of a paper web expiring from a reel of paper onto the leading edge of a leading portion of a new reel of paper. Still more particularly, this invention relates to an improved method and apparatus for effecting a double-sided tape splice by cross-cutting trailing and leading portions of successive paper webs in paper winder apparatus to produce corresponding trailing and leading edges which are held in adjacency while opposed adhesive tapes are applied to, and pressed against, each side.

2. Description of the Prior Art

The art of splicing paper webs, such as those produced by papermaking machines in large diameter wound web rolls, commonly referred to as reels, is evolving rapidly, primarily due to the increasing machine speeds required to be competitive. These large diameter wound web rolls, or reels, are produced successively after being wound up in apparatus at the end of a papermaking machine, which apparatus is also called a reel. Due to sheet breaks which occur from time to time in the paper manufacturing process, the long strips of paper web are quickly, but often somewhat crudely, glued together in order to permit the reel being wound to achieve its desired diameter of five or six feet, or larger.

These reels are then rotatably mounted successively in re-reeling, or winding, apparatus where the reels are rewound and the splices are made better to produce a uniform diameter finished wound web roll which is shipped to the ultimate user, such as a newspaper or printing company. While the ultimate reel is a single strip of paper web wound to the desired diameter, such perfection, while it is more closely attained than in the past, has not yet been achieved. Further, while it has been fairly easy to effect a splice between shorter strips of paper web, the ultimate splice is one known in the industry as a "saleable splice." That is, the splice is so good that a reel containing such a splice is acceptable to the customer and does not have to be sold at a discount.

Prior wet paper web splicing concepts are shown and described in U.S. Pat. Nos. 5,169,082; 5,288,034; 5,279,471; and 5,259,910.

Typical of prior concepts for effecting web splices are apparatus which splice the off-going and on-coming webs together by overlapping the webs and providing either glue or double-faced adhesive tape between the webs, and then pressing the webs together to make the splice. While such splices can be made relatively quickly and adequately function to hold the spliced webs together, they also produce an unattractive splice which has loose ends on both the upper and lower sides of the spliced web. Further, the splice takes up considerable distance in the machine direction, so the paper product extending in both the upstream and downstream directions along the spliced web is not saleable and must be removed in subsequent processing, either at the paper mill or the customer.

SUMMARY OF THE INVENTION

This invention obviates the non-precise and relatively lengthy splices, taken in the machine direction, of prior methods and apparatus. In this invention, both the trailing portion of the off-going web of an expiring reel, and the leading portion of an in-coming web on a new reel, are cut in the cross-machine direction while the webs are held in supporting engagement on the surface of a selectively movable support beam. Both of these leading and trailing web portions are held against the beam surface by means, such as vacuum pressure applied to a foraminous surface on the beam and/or separate clamping apparatus engaging the webs from above the support beam.

In a preferred embodiment, the webs are cross-cut separately and their leading and trailing edges define a slight gap or space as they extend parallel in a cross-machine direction.

The apparatus includes a carriage mounted to a beam positioned over the intended path of the webs as they travel through the apparatus. The beam extends in the cross-machine direction so that the carriage can traverse the webs' widths. On the carriage is mounted the web cross-cutting apparatus as well as web lifting and separating apparatus which engages both webs simultaneously on one side of the webs, at side edges intersecting their leading and trailing edges, the lifting and separating apparatus operating to lift the leading and trailing edges of the webs as the carriage traverses the webs in the cross-machine direction. As the webs are lifted, they are maintained separated for a brief time which is a function of the length and configuration of the web lifting and separating apparatus.

This moving, local separation of the webs defines a splice bed which is momentarily formed in the space between and following the lifted and separated localized divergence between the leading and trailing webs. Apparatus for dispensing an adhesive tape is also mounted on the carriage and positions tape with a non-adhesive side supported on the support beam surface beneath the now-separated leading and trailing web edges, with an adhesive side of the tape facing the lifted and separated web leading and trailing edges.

As the carriage traverses the cross-cut webs, the tape is laid down and pressing apparatus, such as a roller or stationary bar, which, in a preferred embodiment, is mounted to another carriage, downstream of the first carriage, presses the leading and trailing edges against the adhesive side of the tape to effect a clean, high-quality splice.

In a preferred embodiment, a second tape apparatus, mounted on a second carriage, which follows the traversing first tape apparatus, applies a second tape to the leading and trailing edges of the webs over the first tape with an adhesive side of the second tape facing the two webs. The pressing apparatus follows the second tape apparatus to press the second tape against the two webs over the first tape to create a splice having two tapes with opposed adhesive sides on either side of the two webs over the leading and trailing edges of the webs, to create a short, clean, high quality splice having no exposed adhesive surfaces on the two tapes.

Accordingly, it is an advantage of this invention to provide a neat, clean and, in a preferred embodiment, a double-sided taped splice over cross-cut leading and trailing edges of in-coming and off-going portions of separate paper webs.

Another advantage and feature of this invention is the use of a traversing carriage in the web splicing apparatus for quickly and accurately effecting a high-quality splice of two paper webs.

Another advantage and feature of this invention is the provision of a method and apparatus for effecting a high-quality splice between two paper webs which both cross-cuts both webs, and utilizes adhesive tape on both sides of the spliced webs.

Another advantage and feature of this invention is to provide a method and apparatus for effecting a so-called saleable splice between two paper webs.

Still another advantage and feature of the invention is the method and apparatus for effecting a high-quality splice between two paper webs, which splice takes up very little space in the machine direction.

These, and other advantages and features of the invention will become readily apparent to those skilled in the art upon reading the following description of the preferred embodiments of the invention in conjunction with the attached figures.

DESCRIPTION OF THE PREFERRED EMBODIMENT

Figure 1:
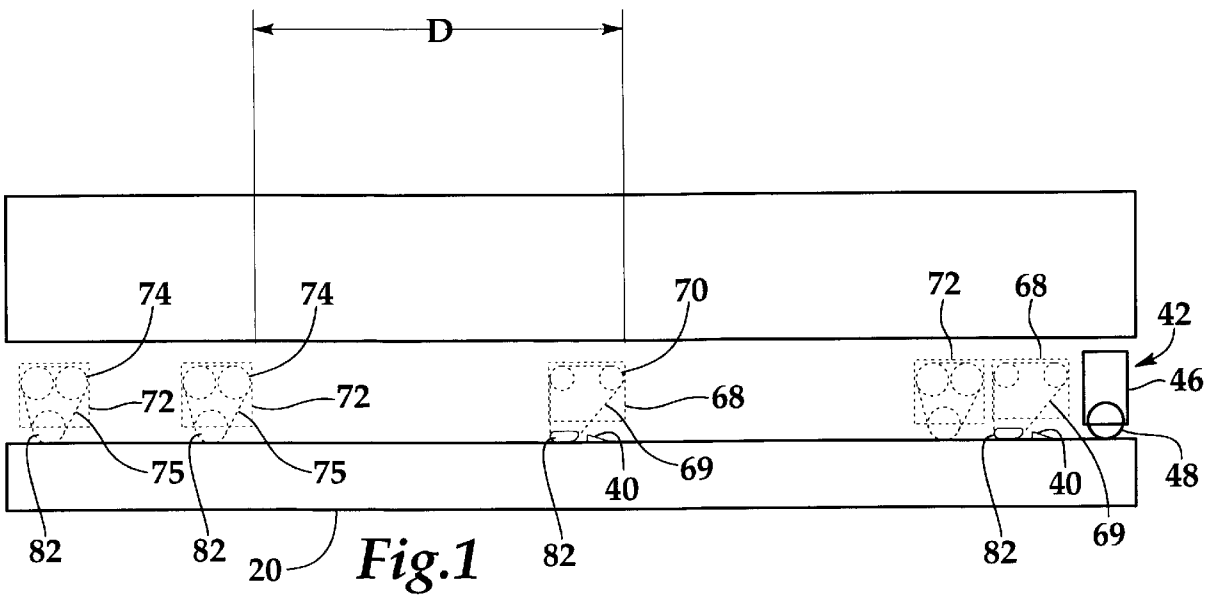
FIG. 1 is a front elevational view showing the web-cutting and first and second tape application apparatus mounted on carriages for traversing the width of the paper webs to be severed and spliced.

With reference to FIGS. 1–4, the web splice apparatus, generally designated with the number 10, is mounted downstream of winder apparatus, generally designated with the number 11 (FIG. 3), which winder apparatus includes a pair of horizontally disposed, parallel rails 12, 12' for supporting the core 14 of a reel 16 of paper web which has previously been produced by a papermaking machine. The reel essentially comprises a wound paper web roll.

The web splicing apparatus includes a guide roll 18 over which the web W from reel 16 is directed for further processing downstream. The paper web W is shown in four possible positions (FIG. 3) corresponding to a new reel, an expiring reel, both of which can be rotated in either direction as desired by the user.

A web support beam 20 (FIG. 1) is mounted in the splicing apparatus 10, for pivotal movement into web-supporting position 20*a* (FIG. 1*a*) and web non-supporting position 20*b* (FIG. 3) as desired. Also mounted to the splicing apparatus 10 is a pivotal (44) web-clamping apparatus 24, comprising an arm 26 on which a web-holding clamp 28 is mounted.

As used above, a convention will be used wherein a prime mark (') will designate a corresponding item, such as a rail, on the other side of the apparatus (usually not shown), and a subscript (a, b, etc.) will be used to designate another position of a moveable structural item, such as support beam 20, 20*a*.

On the web-splicing apparatus, between the web-support beam 20 and the reel 16 is a pivoted threading roll 30 comprising a vacuum roll 32 mounted between a pair of pivotable arms 34, 34' which pivot about a mounting axis 36. The arms 34, 34', one on either side of the apparatus, can extend, as shown by number 38, to position the threading roll 30 from a position in nipping engagement N with the new reel 16 to a splicing position S where the threading roll is pressed against the surface of the support beam 20. The threading roll is rotated while in nipping engagement N with the reel so as to wind a few layers of the new paper web onto it in order to positively move and direct the new paper web downstream to a desired position S by extending its arms outwardly (38 in FIG. 3) to position the threading roll such that when the threading roll is rotated downwardly over the support beam which has been moved into web-supporting engagement position, the new web is brought into taut engagement in support with the surface 21 of the support beam 20.

Figure 1B:
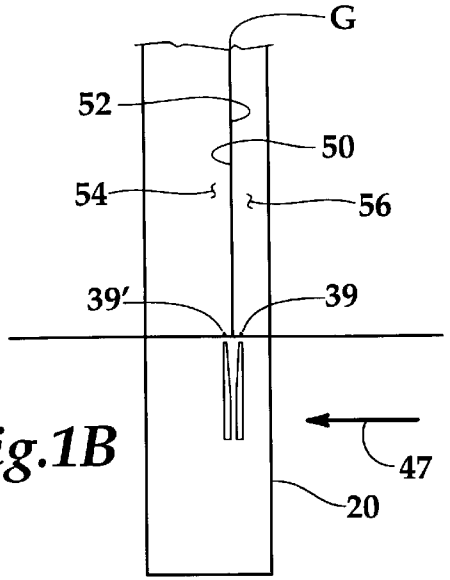
FIG. 1B is a plan view along view Section 1B—1B shown in FIG. 1A. This figure shows the web lifting and separating apparatus in conjunction with the cut edges of the old and new paper webs.
Figure 1A:
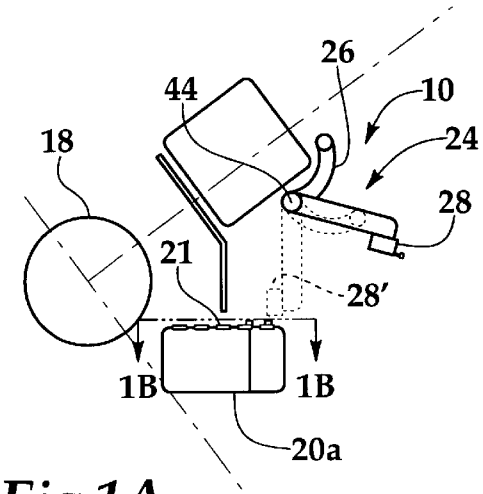
FIG. 1A is an end-elevational view of the apparatus shown in FIG. 1, and additionally showing a guide roll and a mounting beam for mounting the traversing taping and web cross-cutting apparatus.
Figures 2, 2A, 2B, 2C:
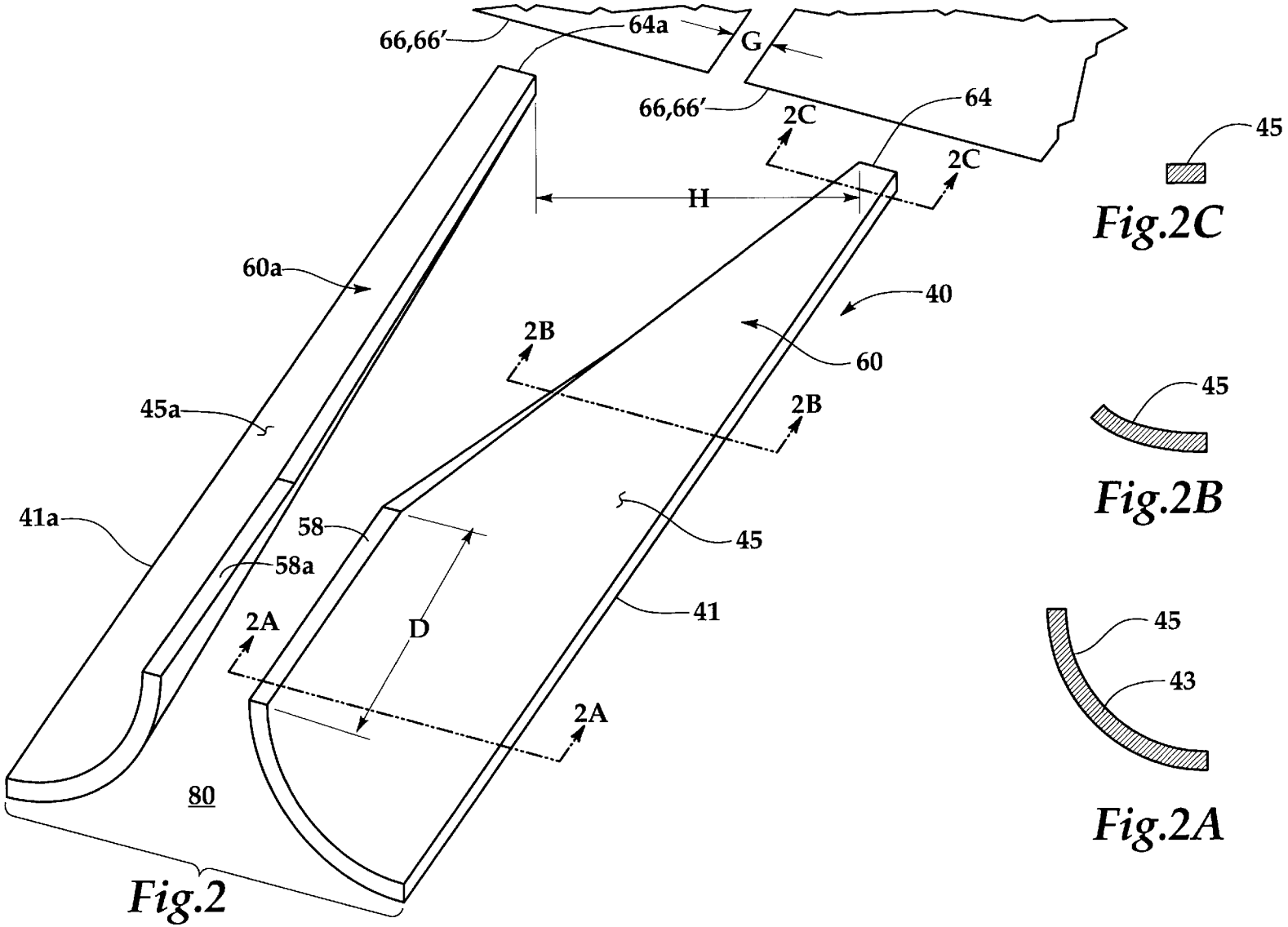
FIG. 2 is a perspective view of the web lifting and separating apparatus.
FIG. 2A is a section view along lines 2A—2A in FIG. 2.
FIG. 2B is a section view along lines 2B—2B in FIG. 2.
FIG. 2C is a section view along lines 2C—2C of FIG. 2.
Figure 3:
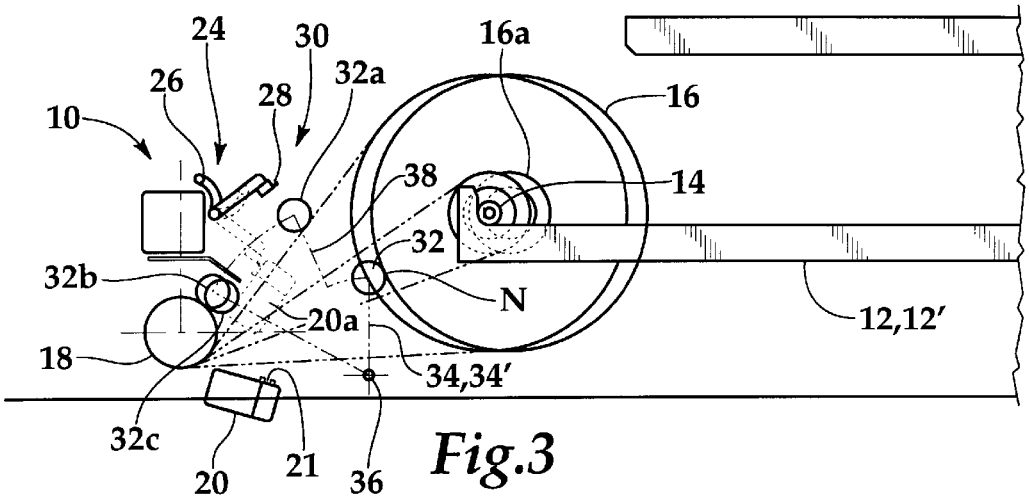
FIG. 3 is a side-elevational view of the splicing apparatus showing the web from the new reel guided off the reel by the guide roll, regardless of the direction of rotation of the new reel.

In FIG. 1A, the splicing apparatus 10 shown in FIG. 3, has been rotated counterclockwise about 30° in order to more clearly depict the web edge-lifting and separating apparatus, shown generally as item 40 in FIG. 2.

With reference to FIGS. 1 and 1A, a web cross-cutting apparatus 42 is shown which includes a carriage 46 to move into, and out of, web cross-cutting position, shown in position on one side of the web. The web cross-cutting apparatus carriage 46, shown in FIG. 1, is mounted to the splice apparatus 10 for traversing movement relative to the web support beam 20 which is shown raised into its web supporting position 20*a* in FIG. 1A. The web support beam extends in the cross-machine direction, which direction is at right angles to the direction of web movement, designated by arrow 47 in FIG. 1B, in the apparatus during steady-state operation. A blade 48 is mounted to the carriage to bear against the web to cross-cut the web to thereby create the trailing edge 52 on the trailing portion 54 of the web expiring from the reel 16*a*. A corresponding leading edge 50 is created on a corresponding leading portion 56 of the web, as will be described in more detail subsequently.

In FIGS. 1B and 2 is shown web lifting and separation apparatus 40 in more detail. The web lifting and separation apparatus 40 comprises a pair of mirror-image curved pieces 41, 41*a* which, at one end view (from downstream looking upstream) of each take the form of a 90° sectional segment 43, 43*a* of a ring, one of which is shown in FIG. 2A. The parallel upper walls 58, 58*a* extend upstream for a distance D. At this point, the upper wall tapers downwardly toward the lower portion 60, 60*a* of each of the partial tube-like segments or pieces 41, 41*a*, one of which is shown in FIG. 2B. At the distal ends 64, 64*a* (upstream), each of the partial, tube-like segments comes to a relatively thin, relatively flat, knife-like point, or narrow edge, for engaging the side edges of the leading and trailing portions of the on-coming and off-going webs. Accordingly, as can be seen in FIGS. 2, 2A and 2B, the inner surfaces 45, 45*a* on the web edge and separating apparatus 40 is curved and the amount of curve decreases in the direction of the spaced distal ends 64, 64*a*. There is a machine-direction gap H formed between these distal ends.

The web lifting and separating apparatus 40 is mounted to carriage 68 (FIG. 1) downstream of the cutter 48. As such, the individual mirror-image segments or pieces 41, 41*a* are disposed on either side of the leading and trailing edges of the leading and trailing web portions, respectively.

As shown in FIG. 1B, when the webs have been cross-cut to produce the leading and trailing edges 50, 52, respectively, a small gap, designated as item G (FIG. 2) is created between the leading and trailing edges. While a small gap G is preferred (i.e., measured in single digit millimeters), it is anticipated that the leading and trailing edges could be contiguous, so the leading and trailing edges can be described as being adjacent to one another in the context that they may either touch or be spaced apart in a gap with the leading and trailing edges parallel. The leading and trailing portions of the paper webs have, of course, two substantially parallel sides 66, 66' (not shown), one side of which is shown in FIG. 2, which extend in the machine direction (i.e., the direction of web travel in the apparatus).

With reference to FIG. 1, in a preferred embodiment, there are three carriages in the apparatus for traversing the webs from side to side in the cross-machine direction. One carriage 46 mounts the web cross-cutting apparatus, including circular blade 48. Another, first taping carriage 68, mounts the web lifting and separating apparatus 40 and a first adhesive tape dispensing apparatus 70 mounted downstream (in the cross-machine direction) of the web lifting and separating apparatus. It dispenses a first adhesive tape 69. The last carriage 72 (i.e., the second tape carriage) mounts a second adhesive tape dispensing apparatus 74, which traverses the web edges downstream (in the cross-machine direction) of the first tape dispensing apparatus, and which dispenses a second adhesive tape 75. It also mounts a web-pressing apparatus 82 for pressing the tapes against the splice, as will be explained in more detail below.

Both of the adhesive tape dispensing apparatus are mounted on the same side, i.e., the top side, of the cross-cut leading and trailing edges of the webs as shown in FIG. 1.

Figure 4:
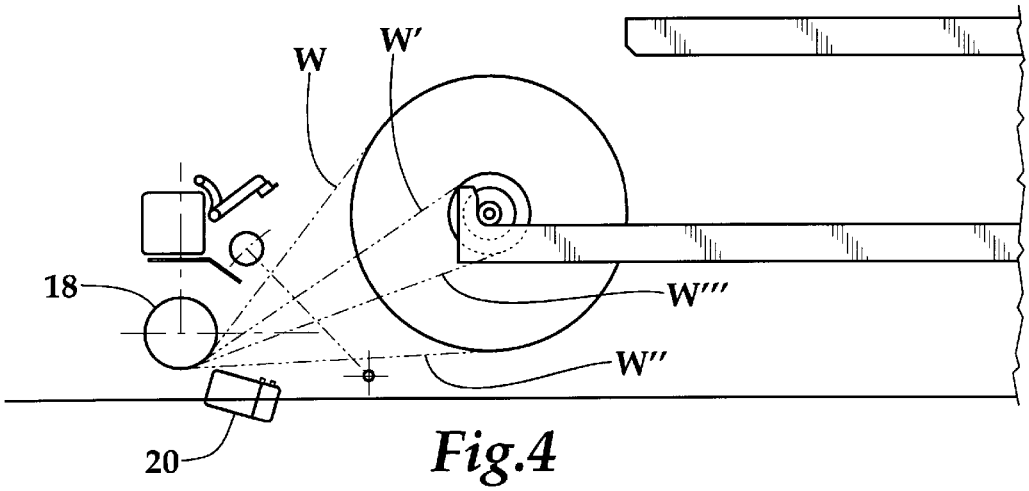
FIG. 4 is a side-elevational view of the web running in steady-state operation through the web splicing apparatus.

In operation, with reference to FIG. 4, the web W, or W", is withdrawn from a reel 16 as the reel comprising a wound web roll decreases in diameter from 16 to 16*a*. Of course, with reference to FIG. 4, the web is withdrawn in only one direction, so the web is only depicted as W or W'; W" or W'", depending on the direction of reel rotation. The web is directed over guide roll 18 which ensures that the web is drawn taut in the span between the reel and guide roll.

Figure 5:
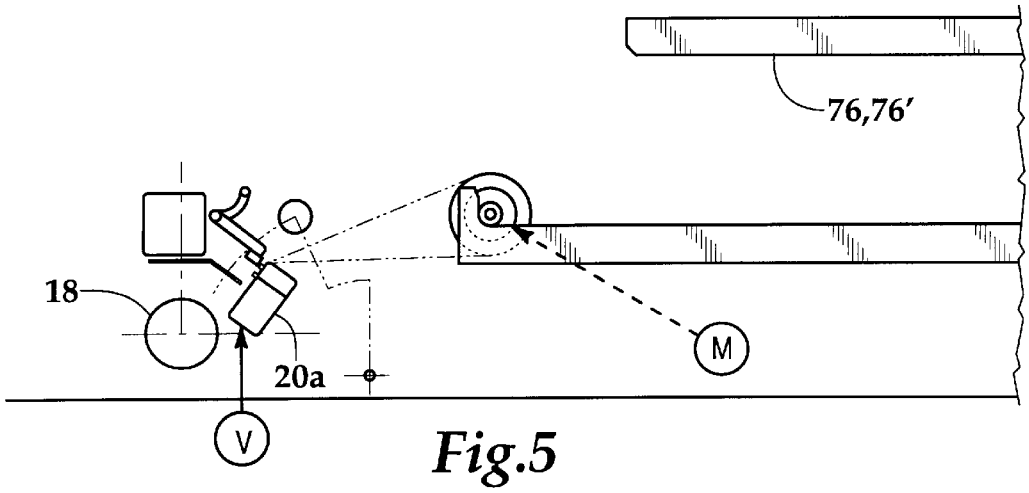
FIG. 5 is a side-elevational view showing the web support beam pivoted up to support the off-going trailing portion of the web from the expiring reel which has been halted.

As the reel winds down to the predetermined size 16*a* shown in FIG. 5, and a splice is to be made, the support beam 20 is pivoted upwardly to its position 20*a* from its stand-by position 20. The winder drive apparatus, such as motor M (FIG. 5) stops the winder at a predetermined diameter of the expiring reel 16*a*. Clamp 28 is lowered so that the web W is held against the upper surface 21 of the support beam 20 by a vacuum pressure applied by a source of vacuum pressure, such as vacuum pump V, applied to the support beam beneath the web and by the clamp applied to the top of the web.

At this point, the carriage 46 containing the web cross-cut apparatus 42 traverses the web from side 66 and cross-cuts the web to form the trailing edge 52 of the trailing portion 54 of the web. The web cross-cut apparatus remains on the other side 66' of the web.

Figure 6:
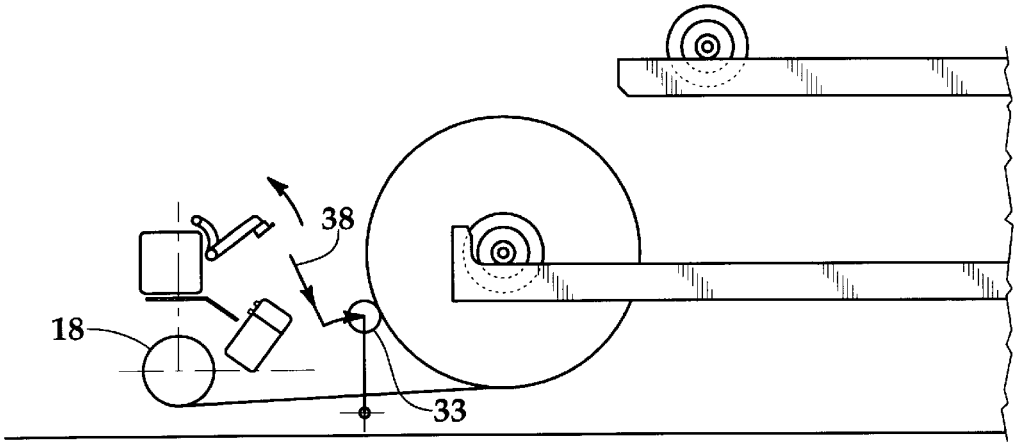
FIG. 6 is a side-elevational view of a new reel placed into position where it can be engaged by a threading roll for threading the on-coming web into the splicing apparatus.

The core 14, on which the expired reel is wound, is lifted by apparatus (not shown) onto a storage facility comprising a pair of laterally spaced, parallel, horizontally disposed rails 76, 76', as shown in FIG. 6.

Figure 7:
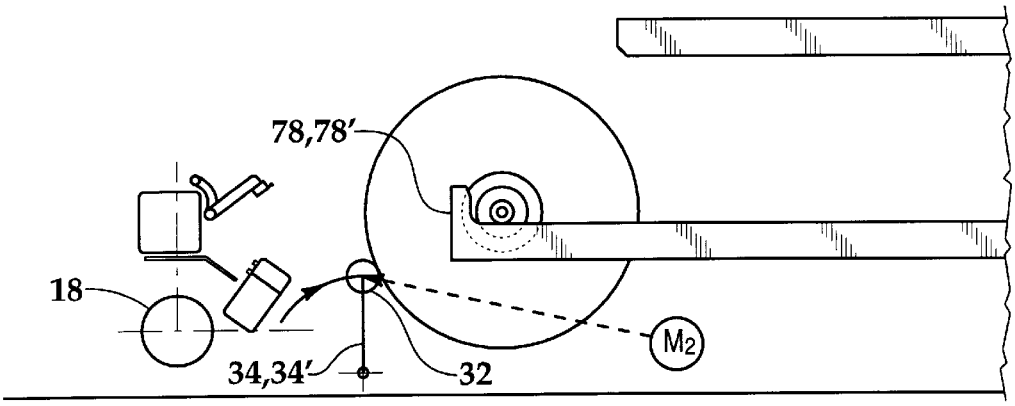
FIG. 7 is a side-elevational view showing the threading roll in position for being wound with a small portion of the on-coming web to be spliced.

With reference to FIGS. 6 and 7, the web clamping apparatus 24 is rotated upwardly out of the way of the support beam 20*a* and the threading roll 32 is retracted and rotated clockwise (shown by movement arrows in FIG. 6) to engage in nipping engagement N with a new reel 16 which has been brought into close proximity with the unwind saddles 78, 78' at the end of the winder apparatus.

In a preferred embodiment, vacuum pressure is applied to the interior of the threading roll 32 by vacuum pump $V_2$ which roll has a foraminous roll cover 33. The threading roll is turned by a motor $M_2$, and the turning roll is wrapped with a few revolutions of paper from the new reel 16. However, it is contemplated that the pick-up of the web from the new reel could be made without the vacuum assist.

Figure 8:
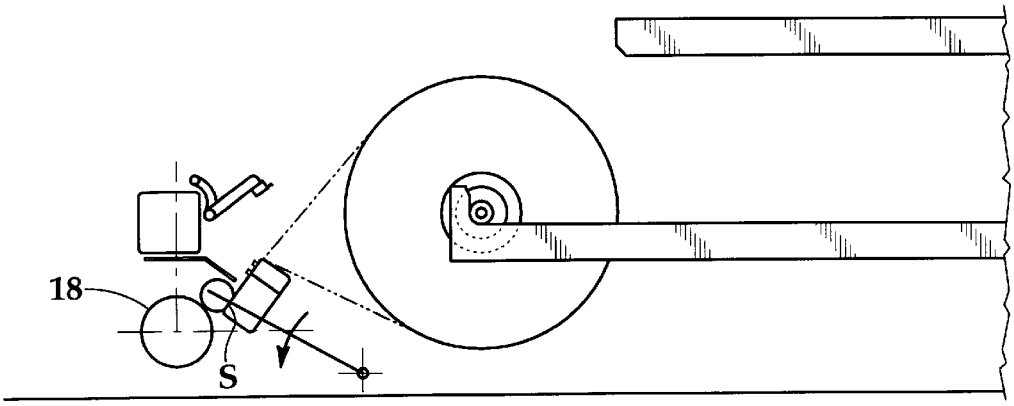
FIG. 8 is a side-elevational view of the threading roll positioning the on-coming web to be cross-cut over the support beam as the new reel is positioned into unwind saddles in the apparatus.
Figure 9:
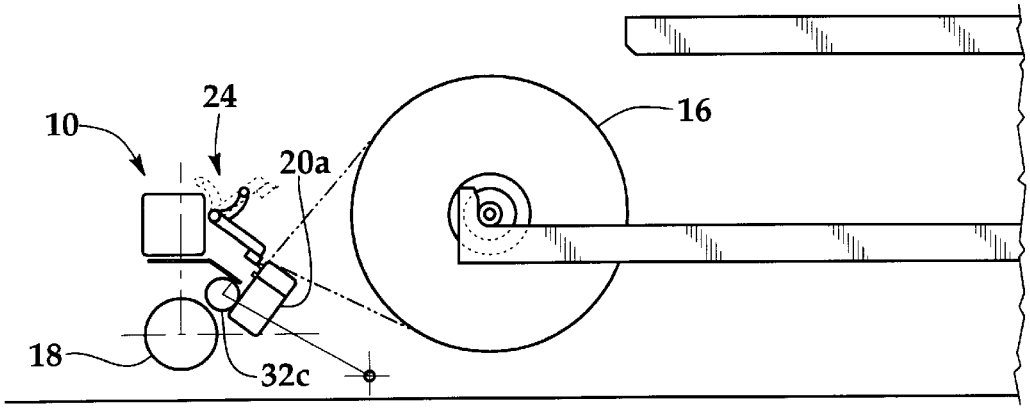
FIG. 9 is a side-elevational view with the new paper web clamped against the web support beam, and showing the carriage mounting the cutting blade in web cross-cutting position.

The arms 34, 34' supporting the turning roll are then extended (threading roll in position 32*a*—FIG. 3) and rotated counterclockwise, with reference to FIGS. 7, 8 and 9, to bring the leading web portion of the sheet, unwinding from new reel 16 and secured onto the turning roll, over the surface 21 of the support beam (threading roll in position 32*b*—FIG. 3) where it partially overlaps the trailing portion of the first web and is held by the vacuum pressure applied to the foraminous surface of the support beam as well as the nipping force of the threading roll in position 32*c* (as shown in FIG. 3). This action brings the new reel 16 into secured rotational mounting in unwind saddles 78, 78'.

The web cross-cutting carriage 46 traverses the support beam again (FIG. 9), beginning from the other side 66' of the web where it stopped after cross-cutting the trailing portion of the old web.

The web cross-cutting apparatus cuts a leading edge 50 in the leading portion 46 of the new web in such a manner that, in a preferred embodiment, a slight gap G is formed in the machine direction, but extending in the cross-machine direction such that the trailing edge of the trailing portion of the expired web, and the leading edge of the leading portion of the new web are parallel.

Figure 10:
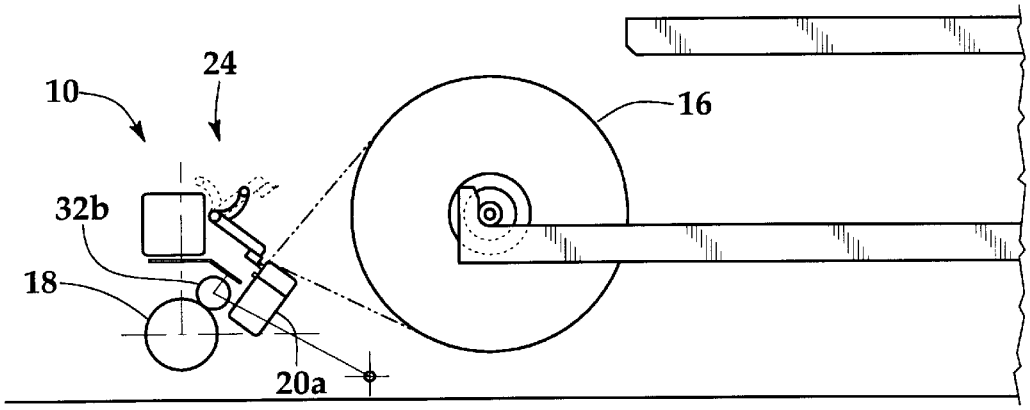
FIG. 10 is a side-elevational view of the threading roll in slightly lifted position to take up the severed on-coming paper web.
Figure 10A:
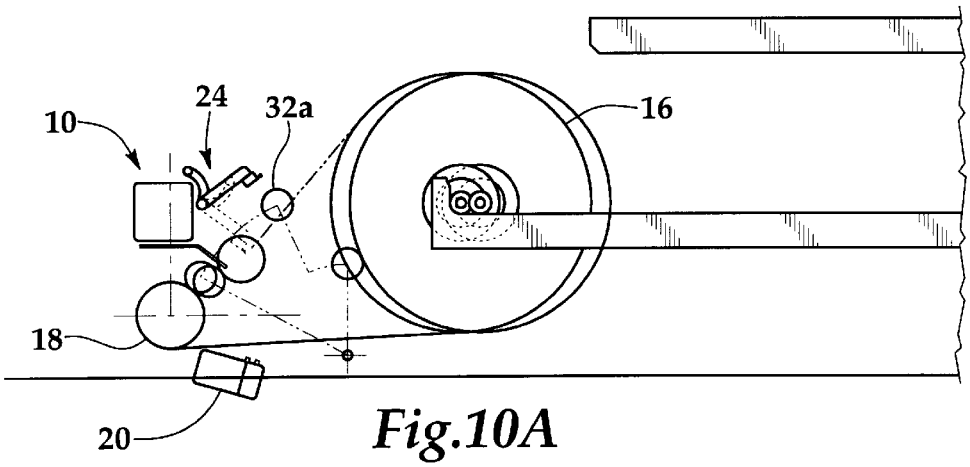
FIG. 10A is a side-elevational view of the apparatus shown in FIG. 10, with the web leading and trailing ends being lifted and separated to prepare for the positioning of the adhesive tape over the support beam.
Figure 10B:
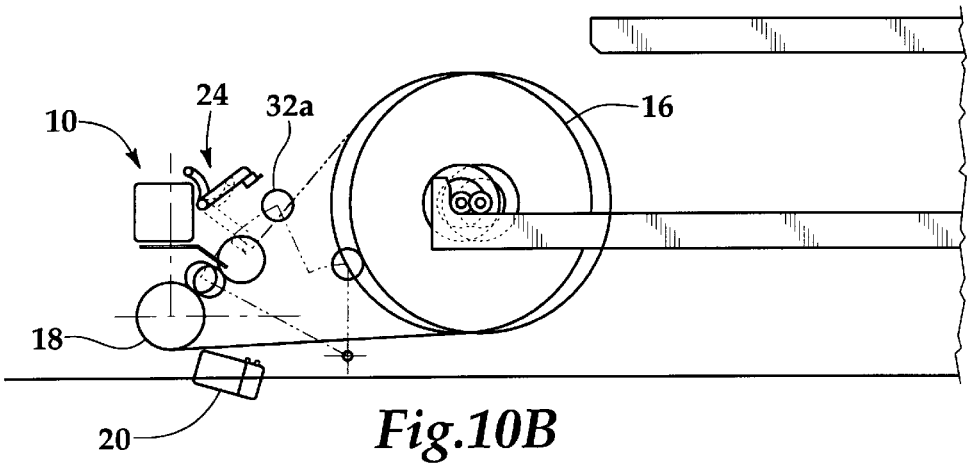
FIG. 10B is a side-elevational view of the apparatus shown in FIG. 10, wherein the tape is placed in supporting engagement with the web support beam.
Figure 10C:
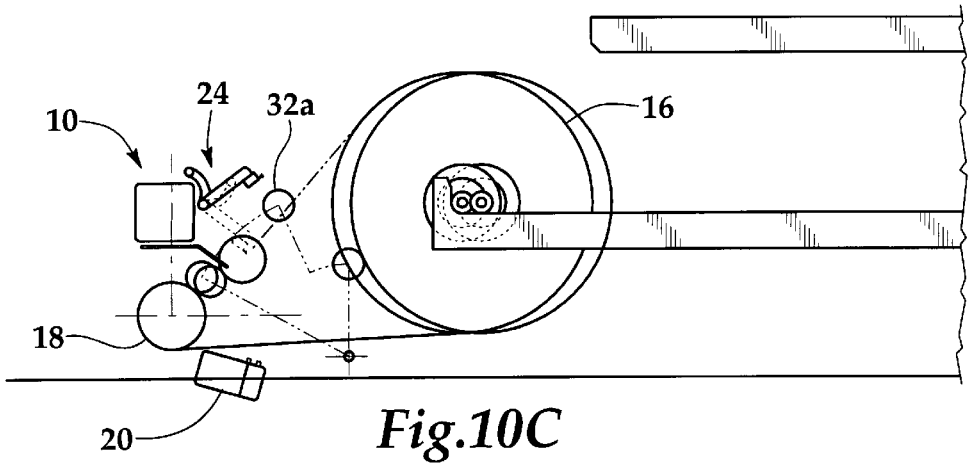
FIG. 10C is a side-elevational view of the apparatus shown in FIG. 10, wherein the ends of the previously lifted and separated webs are pressed down onto the adhesive side of the tape supported over the support beam.
Figure 10D:
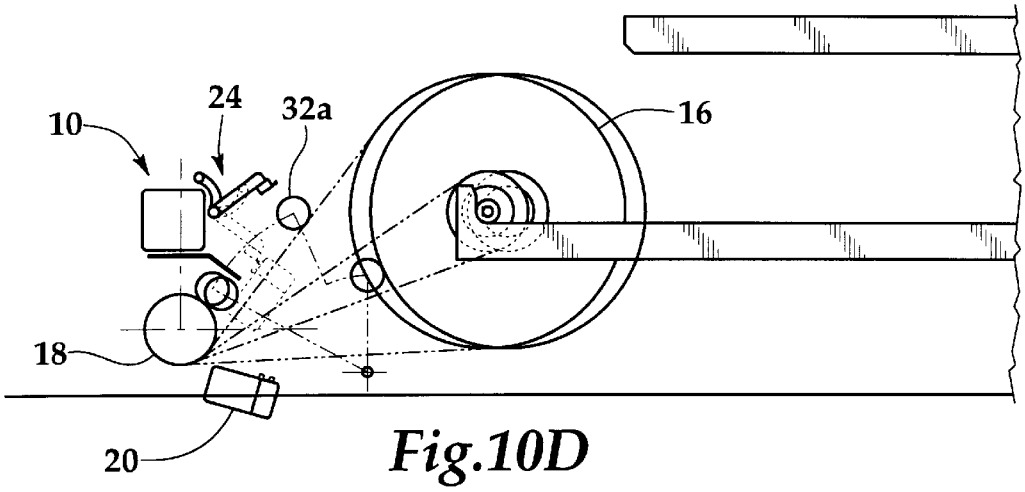
FIG. 10D is a side-elevation view of the apparatus shown in FIG. 10, wherein a second taping apparatus applies a tape to the top side of the webs over the support beam.
Figure 11:
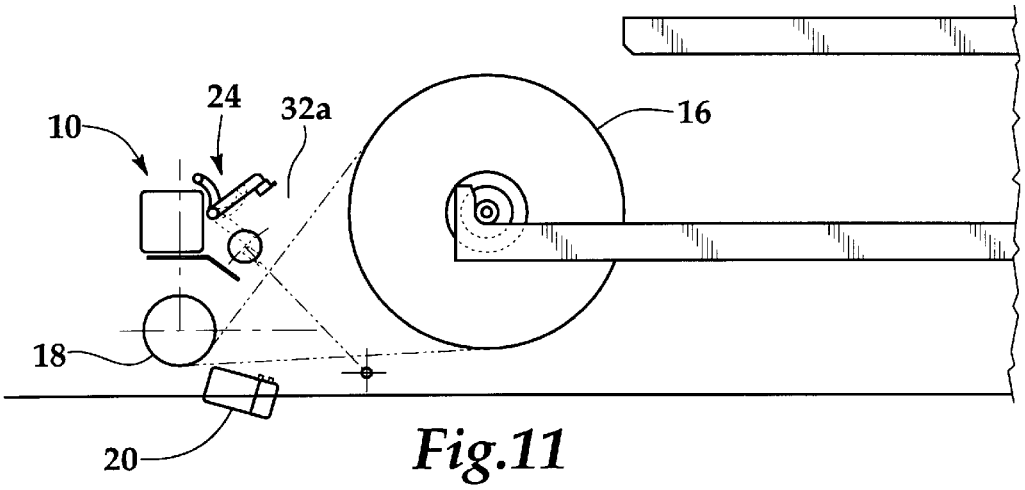
FIG. 11 is a side-elevational view of the apparatus showing the support beam pivoted downwardly out of web-supporting engagement, and the web cross-cutting and clamping apparatus pivoted upwardly out of engagement with the web.

The threading roll 30 lifts on its extended arms slightly (FIG. 10) to bring the severed end of the several wraps of paper web on the threading roll off the surface of the trailing and leading portions 54, 56 of the severed webs.

At this time, a first taping carriage 68 on which the web lifting and separating apparatus 40 is mounted traverses the trailing and leading portions of the off-going and on-coming webs directly over the two cross-cut leading and trailing edges 50, 52 of the webs. As the sides 66 of the webs are initially engaged by the knife-like ends 64, 64*a* of the web edge lifting and separating apparatus 40, the leading and trailing edges 50, 52 of the webs are lifted by the curved inner surfaces 45, 45*a* of each of the mirror-image component pieces 41, 41*a* of the web lifting and separating apparatus 40. This action causes the web edges to form a splice bed 80 disposed beneath the lifted and separated trailing and leading edges of the trailing and leading portions of the webs, respectively. The web lifting action can be assisted by air projected from air-jet nozzles 39, 39' located beneath the leading and trailing portions of the webs (FIG. 1B).

On the same carriage on which the web lifting and separating apparatus is mounted, is mounted a first adhesive tape dispensing apparatus 70 (FIG. 1) on which a roll of adhesive tape 69 is mounted. The tape dispensing apparatus 70 guides and dispenses a strip of adhesive tape 69 into the splice bed 80 against the surface 21 of the support beam with a non-adhesive side of the tape supported on the surface of the support beam. The other side of adhesive tape 69 has an adhesive which is then left facing upwardly toward the still lifted and separated leading and trailing edges of the leading and trailing portions of the two webs.

As the first adhesive tape dispensing carriage passes over the tape laid down on the surface of the support beam, the leading and trailing edges settle downwardly under their own weight onto the adhesive face of the tape. This action completes the splice, which is acceptable as a so-called saleable splice.

In a preferred embodiment, a second adhesive tape dispensing carriage 72 is also used. This second carriage 72 traverses the leading and trailing portions of the webs over and above the leading and trailing edges of the webs which have just been spliced with tape 69. The second carriage 72 has a second adhesive tape dispensing apparatus 74 which dispenses a second adhesive tape 75, which has an adhesive side facing toward the paper webs, and a non-adhesive side facing outwardly from the paper webs. The adhesive side of the tape is brought into engagement with the leading and trailing portions of the paper webs over their respective edges. A web pressing apparatus, generally designated by the number 82, is mounted on the second carriage 72 downstream, relative to the traversing direction of carriage travel, of the second tape dispensing apparatus 74. This web pressing apparatus 82 operates to press the second adhesive tape against the exposed edges of the leading and trailing portions of the webs to effect a splice over the edges which have just previously been spliced by the first adhesive tape 69 from the dispensing apparatus 70 on carriage 68.

In a preferred embodiment, the lowermost adhesive tape applied by the first adhesive tape dispensing carriage 68 is somewhat narrower, such as about 0.75 inches wide, then the outermost adhesive tape 75 might be about 1.5 inches wide, for example.

These steps are shown in FIGS. 10A, 10B, 10C and 10D. The double-positions of reel 16 in these figures is to indicate space for a worker to attend to the apparatus, as well as to provide space to keep the web taut in conjunction with movement of the threading roll.

At this time, when the second adhesive tape has been applied, the web clamping apparatus 28 is rotated upwardly and out of the way, the support beam 20 is rotated downwardly and out of the way, and the arms 34, 34' extend to position the threading roll 30 upwardly out of the way and the newly spliced paper web is started up to run and to unwind the paper web from the new reel 16. The double-sided splice is effected automatically, quickly and is very short in the machine direction. The length of the splice is essentially a function of the widths of the adhesive tapes on either side of the spliced webs.

Since different grades of paper have different physical properties, such as stiffness and stretchability, the ease and speed with which the lifted and separated leading and trailing edges fall back on to the surface of the support beam, so as to permit the splice to be effected, varies. This affects the distance D, shown in FIG. 1, at which the second carriage can follow the first carriage. This distance D is made as short as possible to speed the splicing operation. For example, if a carriage takes 2 seconds to travel a meter, then it would take 20 seconds to traverse a 10 meter wide paper web. Further in this regard, while two carriages 68, 72 are shown and described in the preferred embodiment, it is contemplated that both tapes 70, 74, and the pressing apparatus 82, could be mounted on a single carriage for some grades of paper and/or machine speeds.

Accordingly, an invention has been shown and described which embodies the stated features and advantages, as well as other features and advantages which might be readily discerned by those skilled in the art. Accordingly, the invention, while described with reference to preferred embodiments, is not intended to be limited by such expositive embodiments, but is limited only by the scope of the appended claims.

What is claimed is:

1. Apparatus for effecting a quality splice between trailing and leading portions of separate first and second paper webs, respectively, comprising, in combination:

winder apparatus for supporting one or more winder cores, each core initially having a reel comprising a web wound thereon, each core rotatably supporting the reel when a first paper web is unwound from a first winder core;

a guide roll for receiving the first paper web from its reel and guiding the first paper web downstream;

a web support means selectively movable between web supporting and non-supporting positions in a span of the first paper web between the winder apparatus and the guide roll;

carriage apparatus for mounting web severing means for selectively engaging the first and second paper webs over the web support means and cross-cutting the first and second paper webs from one side thereof to the other side to form a trailing edge on a trailing portion on the first paper web, and an adjacent leading edge on a leading portion of the second paper web, the carriage means adapted and arranged for reciprocal traversing movement relative to the web support means, and the web supported thereon from a first side of the webs to a second side of the webs;

a first paper web clamping means for selectively clamping a trailing portion of the first paper web against the web support means;

a threading roll means for selectively engaging a second paper web from a reel on a successive second winder core rotatably supported on the winder apparatus, the threading roll means movable into proximity with the web support means for bringing the second paper web into supporting engagement with the web support means and for selectively clamping a leading portion of the separate second paper web to the web support means to be severed while supported on the web support means, such severance producing a leading edge on a leading portion of the second paper web;

web lifting and spreading means mounted on the carriage apparatus for engaging the leading and trailing edges of the second and first webs, respectively, at or near one side thereof, and for lifting and separating the leading and trailing edges as the carriage apparatus traverses the webs, such separation of the leading and trailing edges forming a splice bed downstream of the web lifting and spreading means;

tape means mounted to the carriage apparatus, the tape means being so constructed and arranged as to extend an adhesive tape into the splice bed to support a non-adhesive side of the tape on the web support means with an adhesive side of the adhesive tape facing upwardly to face the edges of the first and second tapes;

pressing means mounted to the carriage apparatus to press the edges of the first and second webs against the adhesive side of the adhesive tape to splice the first and second webs together upon traversing movement of the carriage.

2. An apparatus for effecting a quality splice, as set forth in claim 1, further including:

a second tape means mounted to a second carriage apparatus, and being so constructed and arranged for applying a second adhesive tape to the leading and trailing edges of the second and first paper webs, respectively, on the side of the webs opposite the web side facing the web support means, the second adhesive tape having an adhesive side facing the second and first paper webs;

the pressing means is mounted to the second carriage apparatus for pressing a non-adhesive side of the second tape to effect a splice between the first and second webs with the second tape from the second tape means.

3. An apparatus for effecting a quality splice, as set forth in claim 2, wherein:

the second tape means and the pressing means are so constructed and arranged as to apply the second tape to the first and second paper webs and press the tape onto the edges of the webs upon reciprocal movement of the second carriage apparatus as it moves from the other side to its initial position on one side of the first and second webs.

4. An apparatus for effecting a quality splice, as set forth in claim 1, wherein:

the tape means, second tape means, and pressing means are mounted to the carriage apparatus on the same side thereof.

* * * * *